US011401750B2

(12) United States Patent
Gunsaulis

(10) Patent No.: US 11,401,750 B2
(45) Date of Patent: Aug. 2, 2022

(54) TELEMETRY PIPE SYSTEM

(71) Applicant: The Charles Machine Works, Inc., Perry, OK (US)

(72) Inventor: Floyd R. Gunsaulis, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 17/025,278

(22) Filed: Sep. 18, 2020

(65) Prior Publication Data

US 2021/0087889 A1 Mar. 25, 2021

Related U.S. Application Data

(60) Provisional application No. 62/903,501, filed on Sep. 20, 2019.

(51) Int. Cl.
*E21B 17/02* (2006.01)
*E21B 7/04* (2006.01)
*E21B 17/00* (2006.01)

(52) U.S. Cl.
CPC ..... *E21B 17/028* (2013.01); *E21B 7/046* (2013.01); *E21B 17/003* (2013.01)

(58) Field of Classification Search
CPC .. E21B 17/003; E21B 17/028; E21B 17/0285; E21B 17/04; E21B 7/046; E21B 47/024; E21B 47/12
See application file for complete search history.

(56) References Cited

U.S. PATENT DOCUMENTS

| | | | | |
|---|---|---|---|---|
| 6,223,826 | B1 | 5/2001 | Chau et al. | |
| 6,402,524 | B2 | 6/2002 | Wurm et al. | |
| 6,670,880 | B1 | 12/2003 | Hall et al. | |
| 6,763,887 | B2 * | 7/2004 | Boyadjieff | E21B 17/028 166/302 |
| 7,649,474 | B1 | 1/2010 | Gard | |
| 2003/0075319 | A1 * | 4/2003 | Chau | E21B 17/003 166/65.1 |
| 2005/0087368 | A1 * | 4/2005 | Boyle | E21B 47/12 175/57 |
| 2008/0003856 | A1 * | 1/2008 | Hall | H01R 13/533 439/191 |
| 2015/0275626 | A1 * | 10/2015 | Jenne | E21B 7/062 175/45 |
| 2017/0298697 | A1 * | 10/2017 | Loh | E21B 17/003 |

* cited by examiner

*Primary Examiner* — Brad Harcourt
(74) *Attorney, Agent, or Firm* — Tomlinson McKinstry, P.C.

(57) ABSTRACT

A telemetry pipe system used to transmit a beacon signal through a drill string. The system comprises a plurality of pipe sections joined end-to-end to form the drill string, each pipe section having an inner tube made from a conductive material. The system further comprises a plurality of connectors. Each connector is installed within a pipe joint formed between adjoining pipe sections. The connector comprises an elongate spine and a bristle assembly supported on each end of the spine. The spine and bristle assemblies are each made of a conductive material. The spine extends between adjacent pipe sections within the pipe joint such that each bristle assembly is conductively engaged with adjacent inner tubes. The inner tubes and connectors form a conductive path within the drill string for transmitting the beacon signal through the drill string.

24 Claims, 18 Drawing Sheets

TELEMETRY PIPE SYSTEM

SUMMARY

The present disclosure is directed to a connector for use with a drill string. The connector comprises an elongate and conductive spine having an opposed first and second end. The connector also comprises a first and second bristle assembly. The first bristle assembly is formed from a plurality of conductive bristles that conductively engage the spine adjacent its first end, extend radially therefrom and are arranged peripherally thereabout. The second bristle assembly is formed from a plurality of conductive bristles that conductively engage the spine adjacent its second end, extend radially therefrom and are arranged peripherally thereabout. The connector further comprises a rigid nonconductive stop element supported by the spine intermediate its first and second ends.

BRIEF DESCRIPTION OF THE DRAWINGS

FIG. 16 is a perspective view of another embodiment of a pipe section with the connector shown in FIG. 15 partially installed.

DETAILED DESCRIPTION

Figure 1:
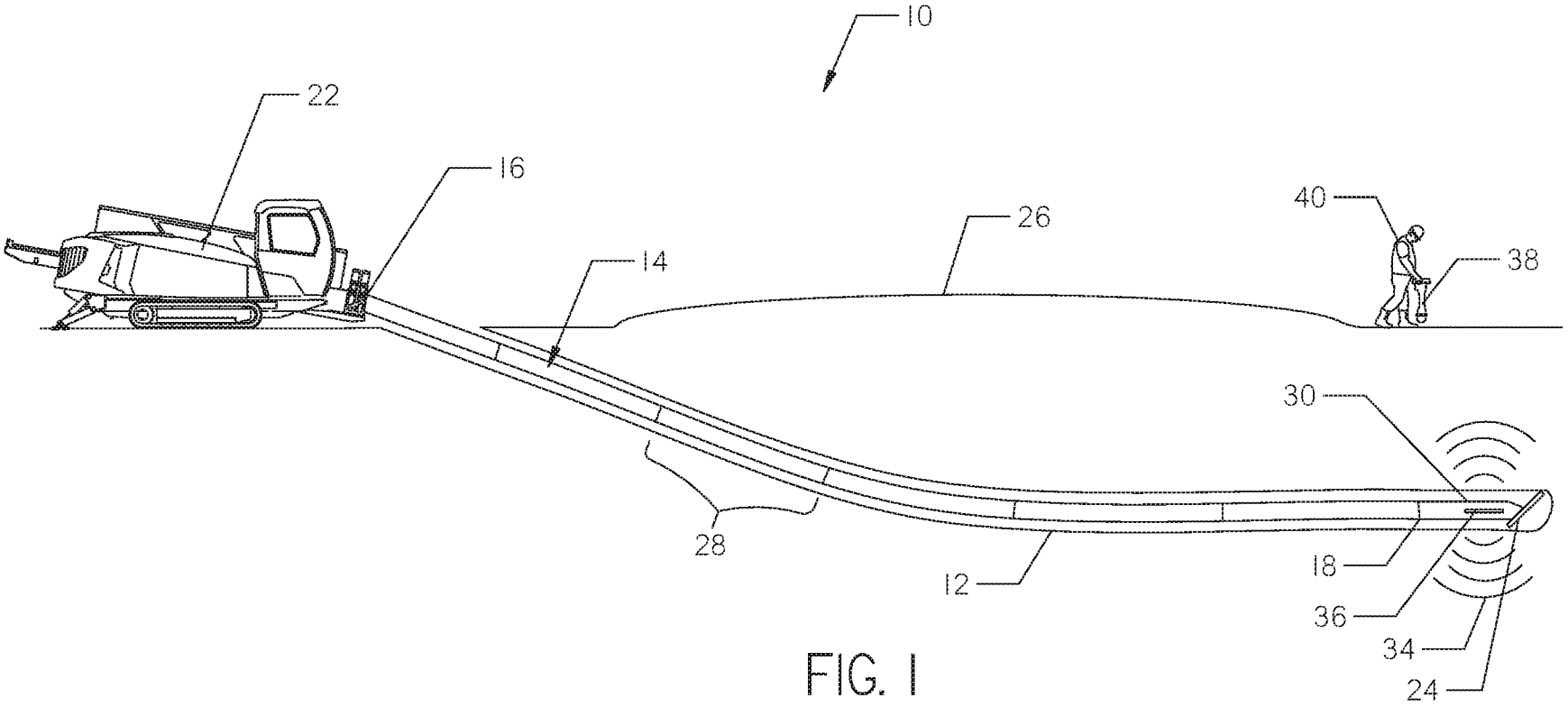
FIG. 1 is an illustration of a horizontal directional drilling operation.

With reference to FIG. 1, a horizontal directional drilling system 10 is shown. The system 10 is used to create a borehole 12 under an above-ground obstacle, such as a roadway. The system 10 uses a drill string 14 having a first end 16 and a second end 18. The drill string 14 is attached to a drill rig 22 at its first end 16 and a drill bit 24 at its second end 18. The drill rig 22 is supported on a ground surface 26 and is operated by a rig operator. The drill string 14 comprises a plurality of hollow pipe sections 28 arranged in an end-to-end relationship. The drill string 14 functions to transmit thrust and rotation force from the drill rig 22 to the drill bit 24 and deliver drilling fluid to the drill bit 24.

Continuing, with FIG. 1, a downhole tool 30 is attached to the second end 18 of the drill string 14. The downhole tool 30 carries the drill bit 24 and houses a beacon 32, shown in FIGS. 9 and 10. The beacon 32 is configured to emit a magnetic dipole signal 34 through a beacon window 36 formed in the downhole tool 30. The beacon signal 34 includes information about the beacon's underground location, as well as the downhole conditions, such as the downhole temperature and fluid pressure.

In traditional drilling operations, an above-ground tracker 38, operated by a tracker operator 40, detects and analyzes the beacon signal 34. The tracker 38 subsequently transmits the data obtained from the beacon signal 34 to the rig operator at the drill rig 22. The rig operator uses the received data to determine how to steer the downhole tool 30 underground.

In some applications, it may be preferable for the beacon 32 to transmit the beacon signal 34 directly to the drill rig 22, instead of communicating through the tracker 38. One method of transmitting the beacon signal 34 directly to the drill rig 22 is to transmit the beacon signal 34 through the drill string 14. The present disclosure describes a telemetry pipe system that provides a conductive path for the beacon signal 34 within the drill string 14.

Figure 2:
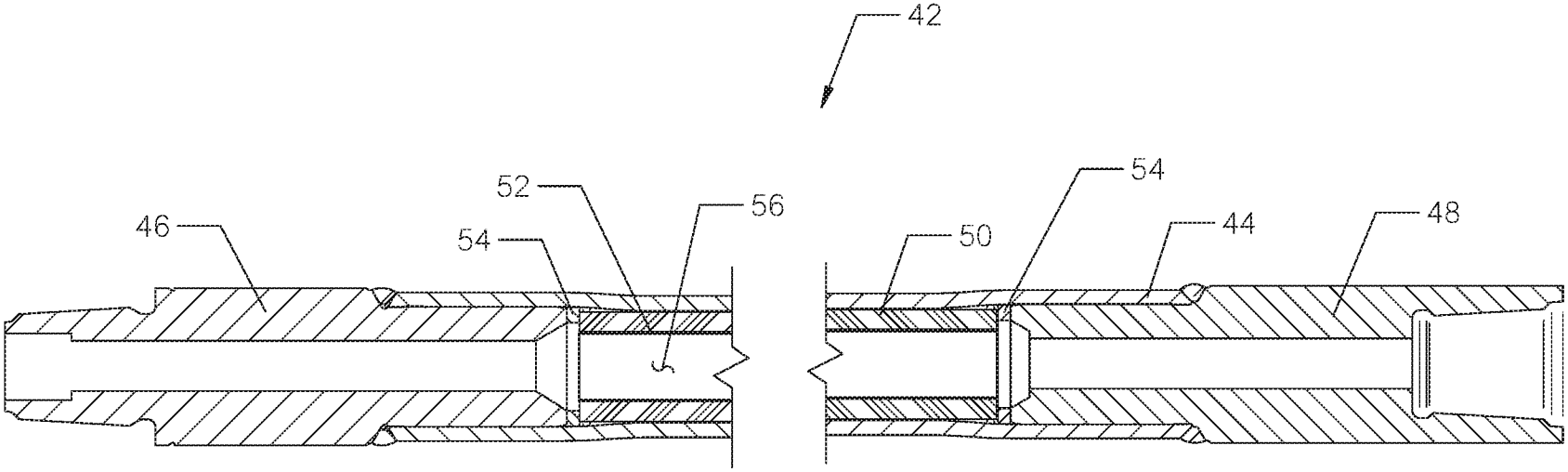
FIG. 2 is a cross-sectional view of a pipe section for use with the drill string shown in FIG. 1.

Turning to FIG. 2, one embodiment of a pipe section 42 that may be used to build the drill string 14 is shown. The pipe section 42 may be used in place of the traditional pipe sections 28 shown in FIG. 1. The pipe section 42 comprises an outer tube 44 having a pin end 46 and an opposed box end 48. The pin and box ends 46 and 48 may be attached to the outer tube 44 or may be integrally formed with the outer tube 44. If attached, the pin and box ends 46 and 48 may be welded or press fit to the outer tube 44. The outer tube 44 and the pin and box ends 46 and 48 are made of a wear-resistant metal, such as steel. Because steel is conductive, the outer tube 44 and pin and box ends 46 and 48 may be considered the outer conductive path of the pipe section 42.

Continuing with FIG. 2, an intermediate tube 50 is disposed within the outer tube 44, and an inner tube 52 is disposed within the intermediate tube 50. The inner tube 52 is made of a more conductive metal than the outer tube 44, such as brass, copper or aluminum. The beacon signal 34 is transmitted through the conductive inner tube 52. Thus, the inner tube 52 may be considered the inner conductive path of the pipe section 42.

The intermediate tube 50 is made of a nonconductive material, such as PVC or other plastic. The intermediate tube 50 insulates the inner tube 52 from the outer tube 44 in order to prevent the metal outer tube 44 from interfering with the beacon signal 34.

Both the intermediate tube 50 and the inner tube 52 stop short of the pin and box ends 46 and 48. A thermal spacer 54, such as a heat-resistant washer, may be positioned between the intermediate tube 50, the inner tube 52, and the pin and box ends 46 and 48. The thermal spacer 54 insulates the intermediate tube 50 from heat during the assembly process if the outer tube 44 is joined to the pin and box ends 46 and 48 by welding. In alternative embodiments, the intermediate tube 50 may abut the pin and box ends 46 and 48. An internal bore 56 extends through the pin and box ends 46 and 48 and the inner tube 52.

During operation, drilling fluid is introduced into the first end 16 of the drill string 14 at the ground surface 26. Drilling fluid flows through the internal bore 56 formed in each pipe section 42 towards the drill bit 24.

Continuing with FIG. 2, the outer and intermediate tubes 44 and 50 may be thicker than the inner tube 52. The outer tube 44 needs to be thick enough to withstand the downhole conditions during operation, and the intermediate tube 50 needs to be thick enough to provide sufficient insulation to the inner tube 52. The inner tube 52 may be very thin, as its primary purpose is to carry the beacon signal 34 through the pipe section 42. Using a thin inner tube 52 also provides more area for fluid to flow within the internal bore 56.

Figure 3:
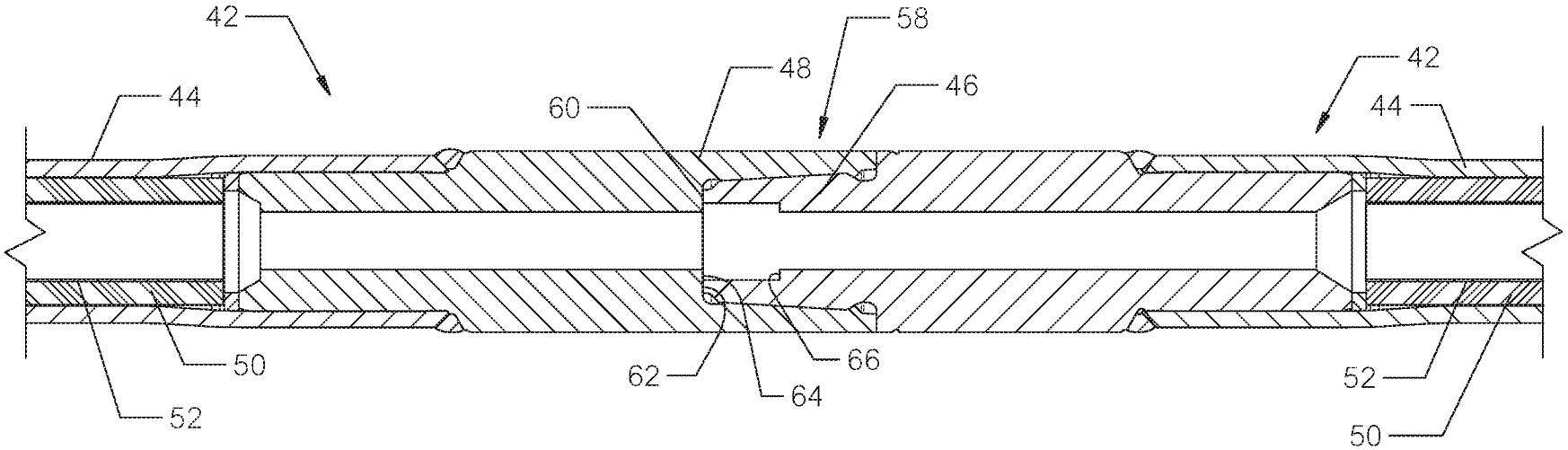
FIG. 3 is a cross-sectional view of a pipe joint formed from adjoining two of the pipe sections shown in FIG. 2.
Figure 7:
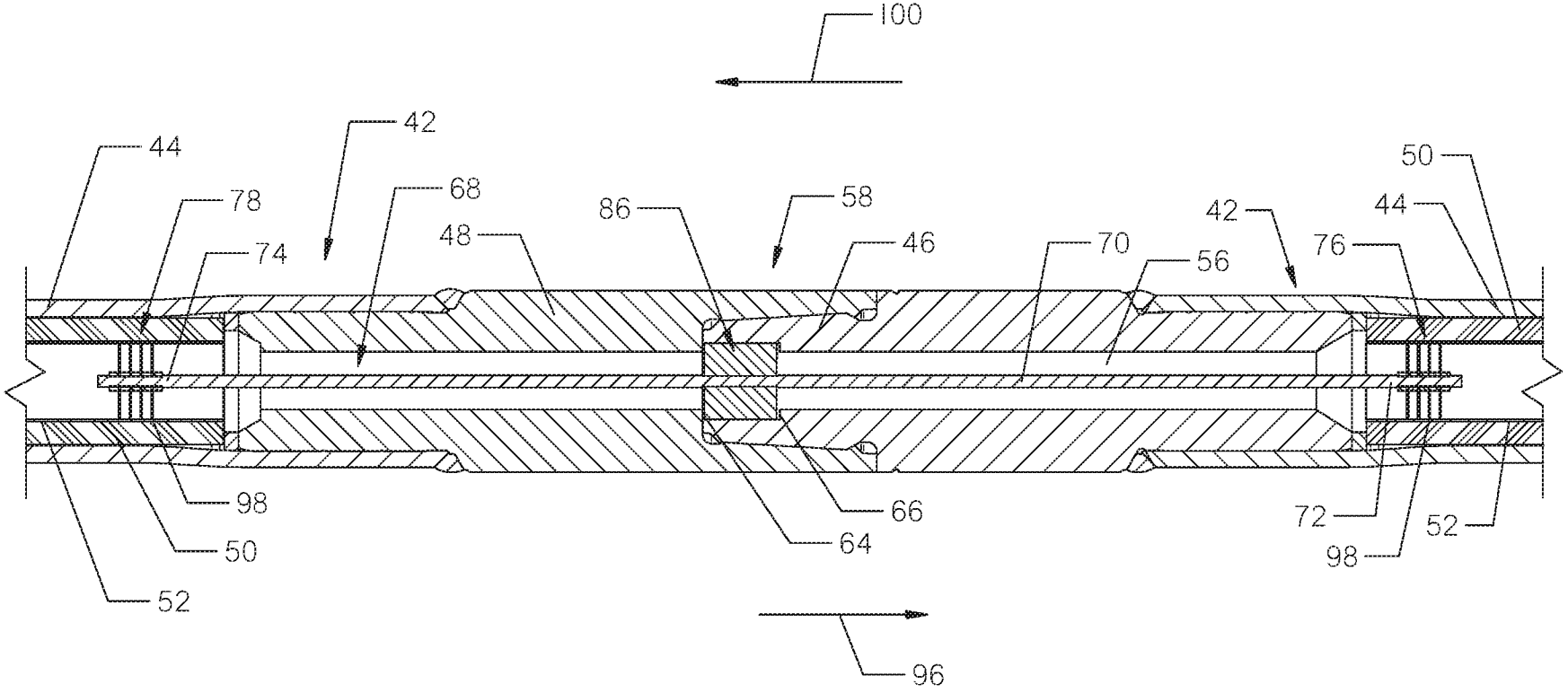
FIG. 7 is a cross-sectional view of the pipe joint shown in FIG. 3 with the connector shown in FIG. 4 disposed within the joint.
Figure 8:
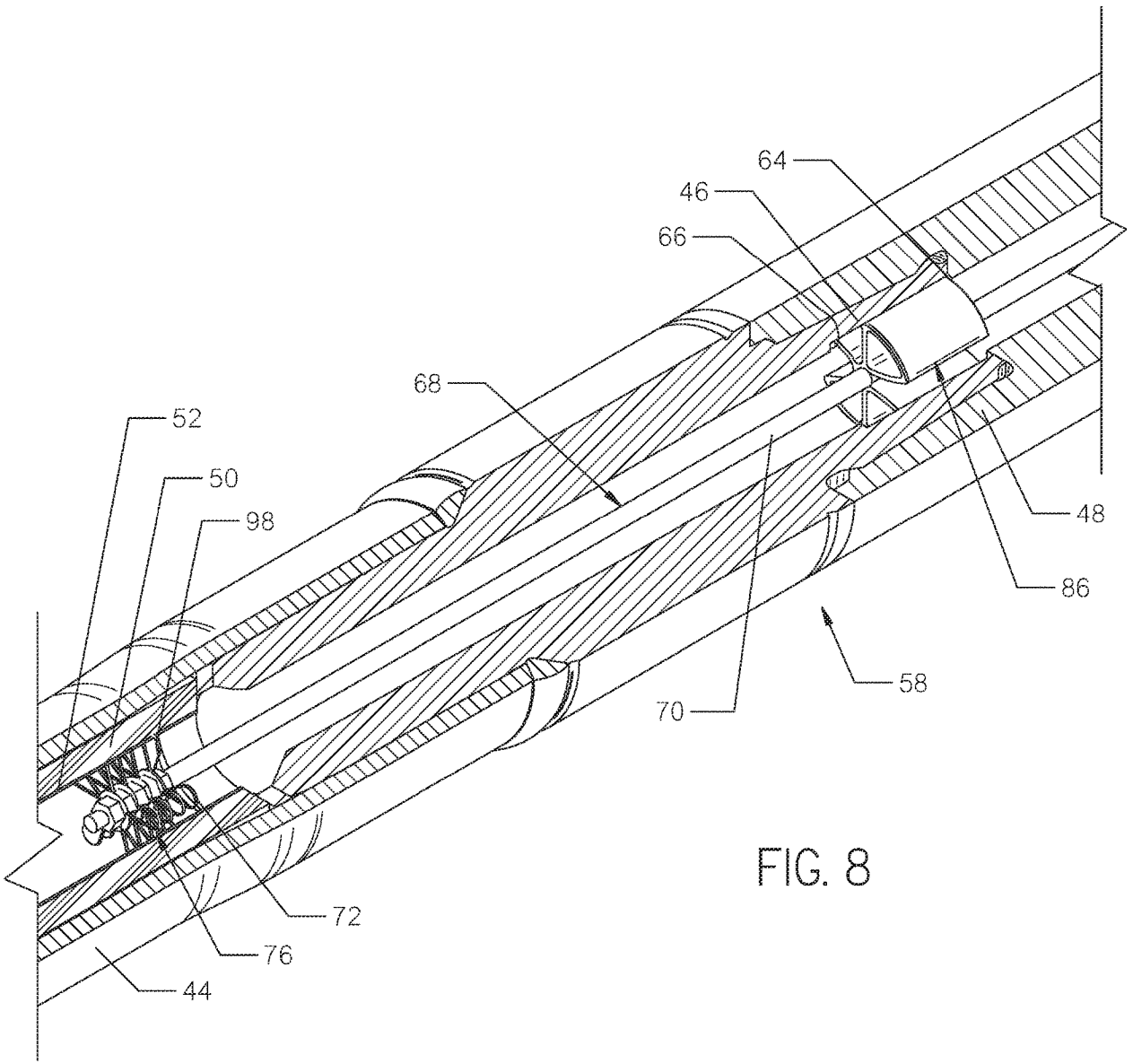
FIG. 8 is a perspective cut-away view of a portion of the pipe joint shown in FIG. 7.

Turning to FIG. 3, the pin end 46 has external threads, while the box end 48 has internal threads. The pin end 46 threads into the box end 48 of an adjacent pipe section 42 to form a pipe joint 58. A front face 60 of the pin end 46 engages an internal face 62 formed in the box end 48 when the pipe joint 58 is made-up. A portion of the internal face 62 surrounding the front face 60 of the pin end 46 remains exposed to the internal bore 56, forming an internal shoulder 64. A corresponding internal shoulder 66 is formed in the walls surrounding the internal bore 56 within the pin end 46. The shoulders 64 and 66 tray have an annular shape and are configured to trap a connector 68 in place within the pipe joint 58, as shown in FIGS. 7 and 8.

As will be described in more detail herein, the connector 68 bridges the gap between adjacent inner tubes 52 within the pipe joint 58. Thus, the connector 68 fills the gaps in the inner conductive path throughout the drill string 14.

Figure 4:
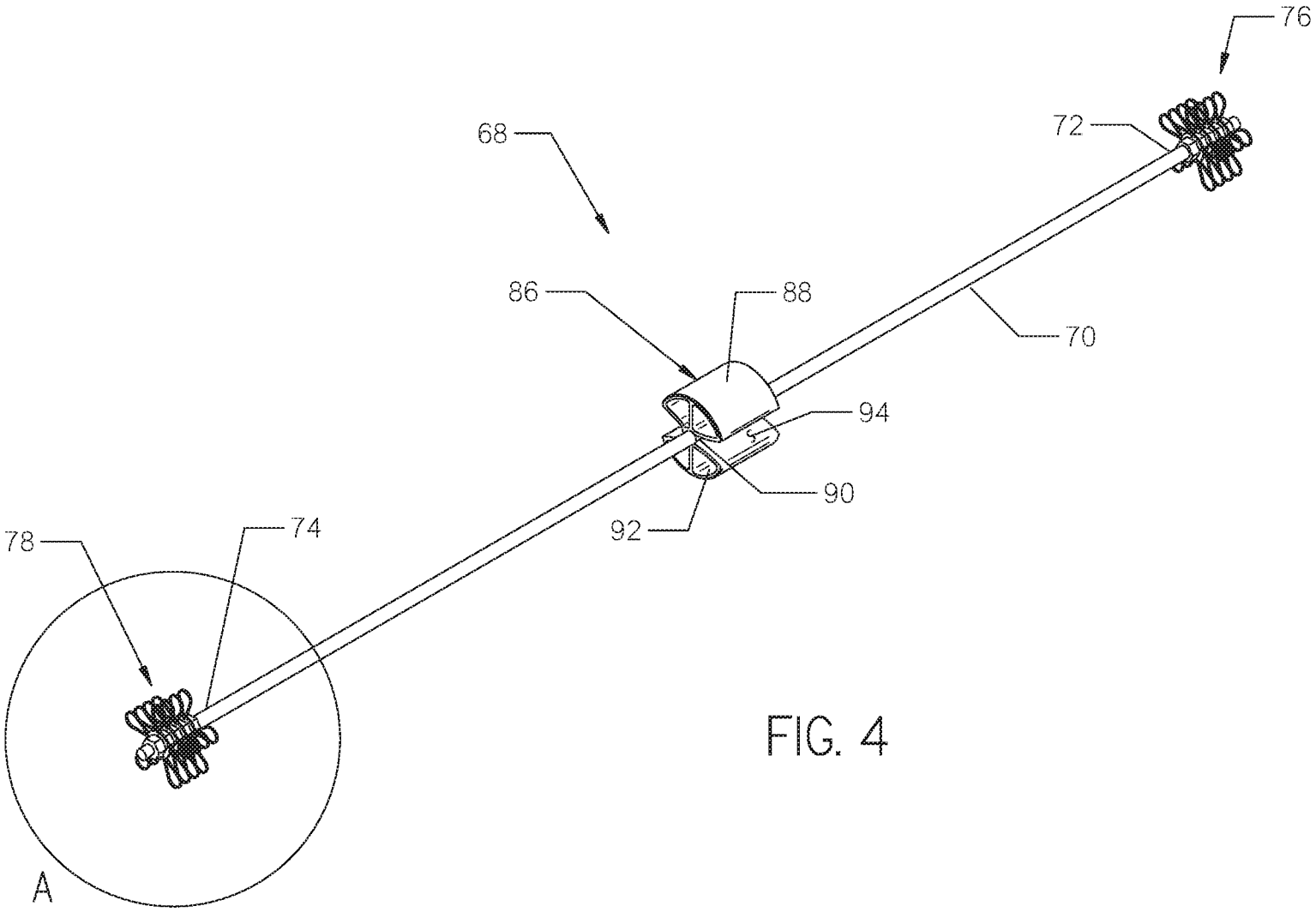
FIG. 4 is a perspective view of a connector.

With reference to FIG. 4, the connector 68 comprises an elongate spine 70 having opposed first and second ends 72 and 74. The spine 70 is made of a conductive material, such as brass, bronze, copper, aluminum, or silver. The spine 70 may be of single-piece construction or may comprise a plurality of wires twisted together. The connector 68 further comprises a first bristle assembly 76 engaged to the first end 72 of the spine 70, and a second bristle assembly 78 engaged to the second end 74 of the spine 70.

Figure 5:
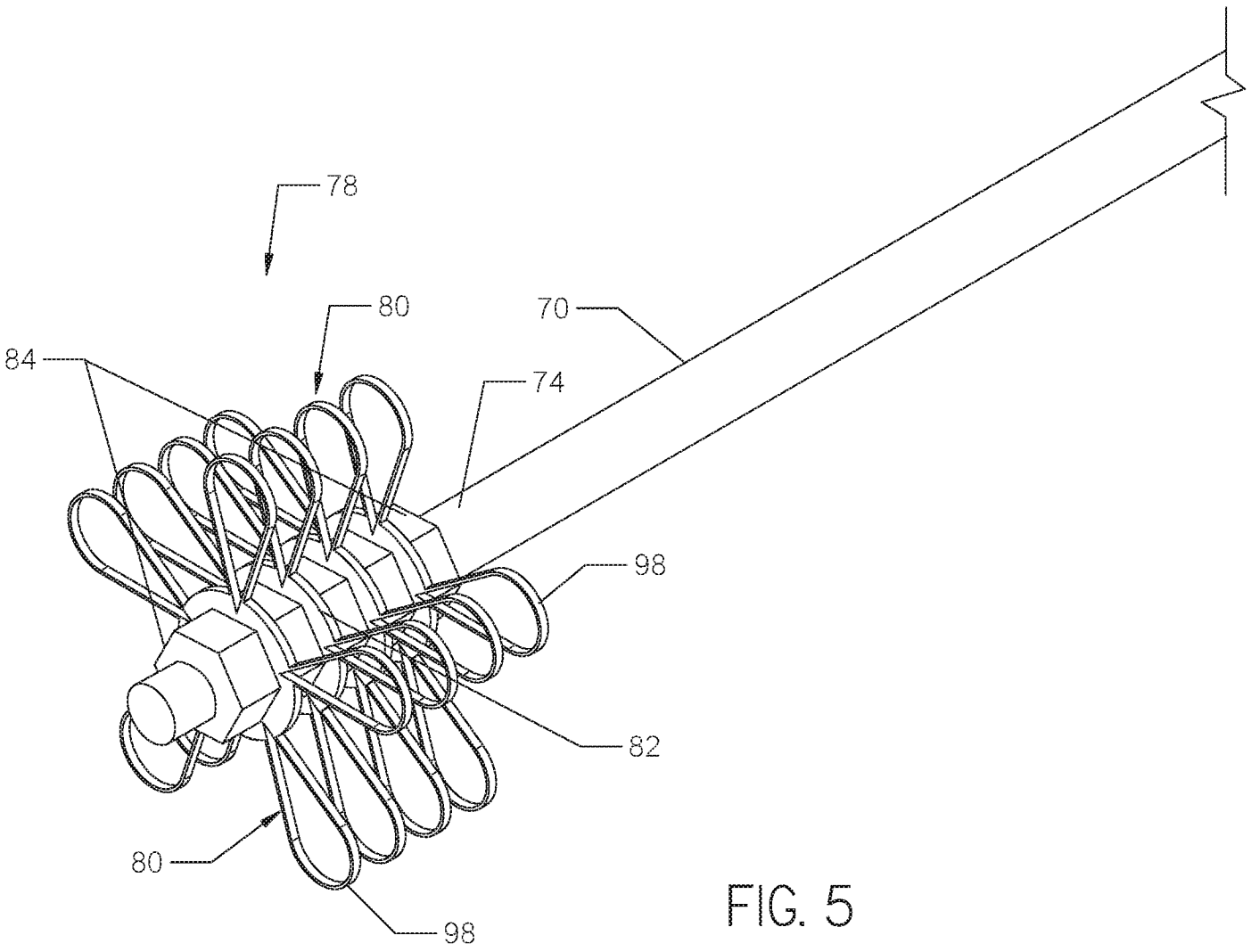
FIG. 5 is an enlarged view of area A shown in FIG. 4.

Turning to FIG. 5, each bristle assembly 76 and 78 comprises a plurality of bristles 80. The bristles 80 shown in FIGS. 4 and 5 each have a looped or teardrop shape. The bristles 80 extend radially from a central support 82 and are arranged peripherally thereabout. The bristles 80 and central support 82 are made of a conductive material, such as brass, bronze, copper, aluminum, or silver and conductively engage the spine 70.

Five bristles 80 are shown extending from each central support 82 in FIG. 5. In alternative embodiments, more than five bristles 80 or less than five bristles 80 may extend from each central support 82. The bristles 80 and corresponding central support 82 may be of single-piece construction. Alternatively, the bristles 80 may be welded to each central support 82. In alternative embodiments, the bristles may have various sizes, shapes, or spacing on each central support. For example, the bristles may comprise individual wire strands affixed to the spine or twisted between a plurality of wires when the spine is composed of wires twisted together.

Continuing, with FIG. 5, each central support 82 has a central hole sized to receive the spine 70. The central supports 82 are held on the ends 72 and 74 of the spine 70 by a plurality of internally threaded spacers 84, such as nuts. The spacers 84 may be made out of metal, such as steel. External threads are formed on each end 72 and 74 of the spine 70 for engaging, with the spacers 84. Each central support 82 is sandwiched between adjacent spacers 84. Five spacers 84 and four central supports 82 are shown in FIG. 5. In alternative embodiments, more or less spacers 84 and central supports 82 may be positioned on each end 72 and 74 of the spine 70. The central supports 82 are positioned on the ends 72 and 74 of the spine 70 so that the bristles 80 are aligned with one another in FIG. 5. In alternative embodiments, the bristles 80 may be positioned so that not all bristles are aligned with one another.

Turning back to FIG. 4, the connector 68 further comprises a rigid stop element 86 supported on the spine 70 between its first and second ends 72 and 74. The stop element 86 resides within a notch formed in the spine 70 and is made of a non-conductive material, such as plastic. Alternatively, the stop element 86 may be molded onto the spine 70 or affixed to the spine 70 using apoxy or other adhesive such that the stop element 86 is not free to move relative to the spine 70. The stop element 86 is configured to hold the connector 68 stationary within a pipe joint 58 by engaging the first and second shoulders 64 and 66 formed in the pipe joint 58, as shown in FIG. 7.

The stop element 86 shown in FIG. 4 comprises a rounded body 88 having a central passage 90. A plurality of openings 92 perforate the body 88. A pair of cutouts 94 are formed in the body 88 shown in FIG. 4. In alternative embodiments, the body may not have any cutouts and instead have a circular cross-sectional shape.

Figure 6:
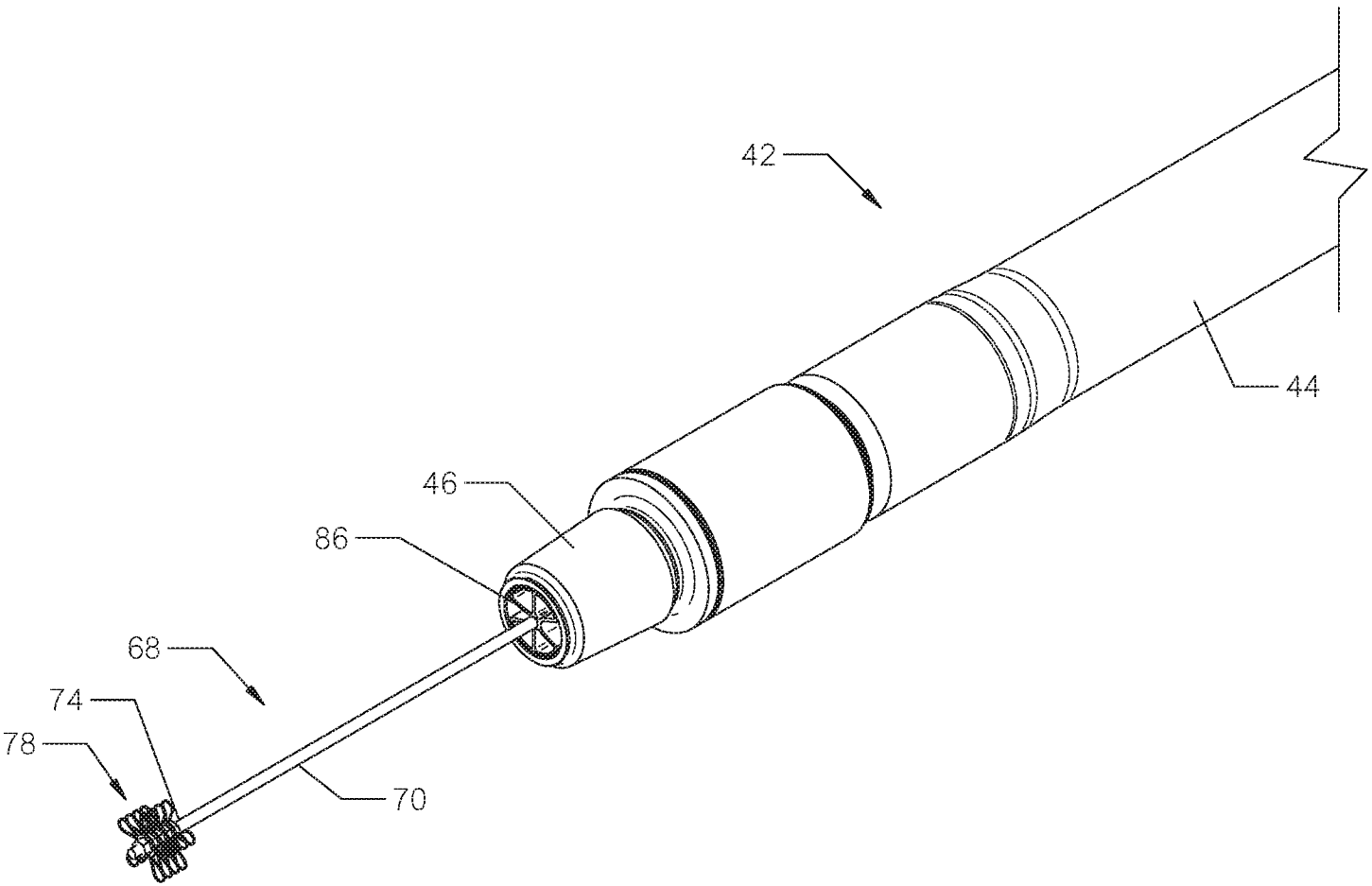
FIG. 6 is a perspective view of the connector shown in FIG. 4 partially disposed within the pin end of the pipe section shown in FIG. 2.

With reference to FIGS. 6-8, the first end 72 of the connector 68 is installed within the internal bore 56 of the pin end 46 until the stop element 86 engages the internal shoulder 66. The second end 74 of the connector 68 is inserted into the box end 48 of adjacent pipe section 42 as the box end 48 joins the pin end 46, forming the pipe joint 58. Once the pipe joint 58 is fully assembled, the internal shoulder 64 engages the opposite side of the stop element 86, securing the stop element 86 in place within the pipe joint 58, as shown in FIGS. 7 and 8.

Continuing with FIGS. 7 and 8, during operation, fluid flowing within the internal bore 56 flows around and through the bristles 80 and the stop element 86. In the embodiment shown in FIG. 7, fluid flows through the pipe joint 58 in the direction of the arrow 96. The direction of fluid flow indicates the orientation at which the pipe sections 42 are attached. The pipe sections 42 shown in FIG. 7 are attached with the pin end 46 facing upstream or "pin-up". In alternative embodiments, the pipe sections 42 may be attached with the pin end 46 facing downstream or "pin down". If the pipe sections 42 are attached "pin down", the fluid flow will be in the opposite direction as shown by the arrow 96 in FIG. 7.

When fluid flows through the "pin-up" drill string 14, the flowing fluid pushes the stop element 86 against the internal shoulder 66 formed in the pin end 46. The pressure applied to the stop element 86 by the fluid flow and the internal shoulder 66 holds the connector 68 in place. Thus, the internal shoulder 64 formed in the box end 48 may not contact the stop element 86 during operation. Therefore, in alternative "pin-up" drill string 14 embodiments, the pipe joint 58 may only include the internal shoulder 66 formed in the pin end 46.

In contrast, if the pipe sections 42 are attached "pin down", the flowing fluid pushes the stop element 86 against the internal shoulder 64 formed in the box end 48. Thus, in alternative "pin-down" embodiments, the pipe joint 58 may only include the internal shoulder 64 formed in the box end 48.

Continuing with FIG. 7, the connector 68 is installed within a pipe joint 58 such that the connector 68 extends between adjacent inner tubes 52. The first bristle assembly 76 is positioned within the inner tube 52 adjacent the pin end 46 of one pipe section 42, and the second bristle assembly 78 is positioned within the inner tube 52 adjacent the box end 48 of the adjoining pipe section 42. Each bristle 80 of each bristle assembly 76 and 78 has a free end 98, as shown in FIG. 5. The free end 98 conductively engages the inner tube 52, as shown in FIGS. 7 and 8.

The beacon signal 34 is transmitted through the drill string 14 in a direction opposite that of the fluid flow, as shown by arrow 100 in FIG. 7. In operation, the beacon signal 34 is transmitted from the inner tube 52 of the downstream pipe section 42 to the first bristle assembly 76. The first bristle assembly 76 transmits the beacon signal 34 to the spine 70 which carries the beacon signal 34 to the second bristle assembly 78. The second bristle assembly 78 transmits the beacon signal 34 to the inner tube 52 of the upstream pipe section 42. The connector 68 thus creates a conductive path between adjoining pipe sections 42. A connector 68 is installed within each pipe joint 58 making up the drill string 14, thereby completing the conductive path extending through the drill string 14.

Figure 9:
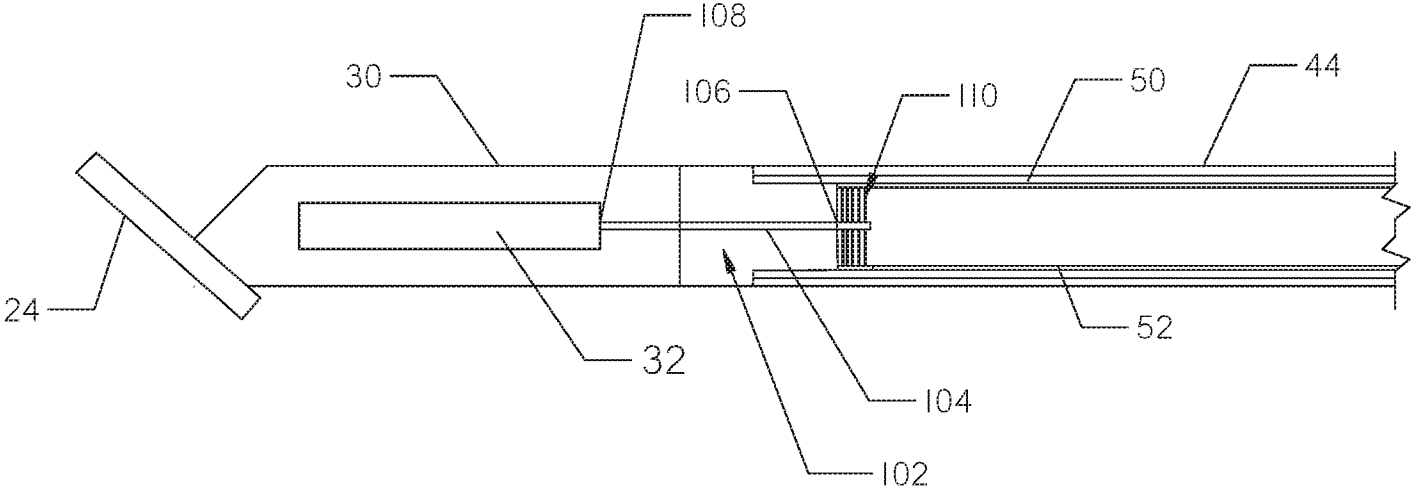
FIG. 9 is a cross-sectional view of a downhole tool attached to a pipe section. Another embodiment of a connector is directly attached to a beacon positioned within the downhole tool.

Turning to FIG. 9, in one embodiment, the beacon signal 34 is introduced into the conductive path through a connector 102. The connector 102 comprises a spine 104 having a first end 106 and an opposed second end 108. The second end 108 of the spine 104 is directly connected to the beacon 32. A bristle assembly no is supported on the first end 106 of the spine 104. The bristle assembly 110 is positioned within an inner tube 52 of a pipe section 42 attached directly to the downhole tool 30. The spine 104 and bristle assembly no may be constructed identical to the spine 70 and bristle assemblies 76 and 78 shown in FIGS. 4 and 5. In alternative embodiments, the spine 104 may be a flexible wire that interconnects the beacon 32 and bristle assembly no.

Figure 10:
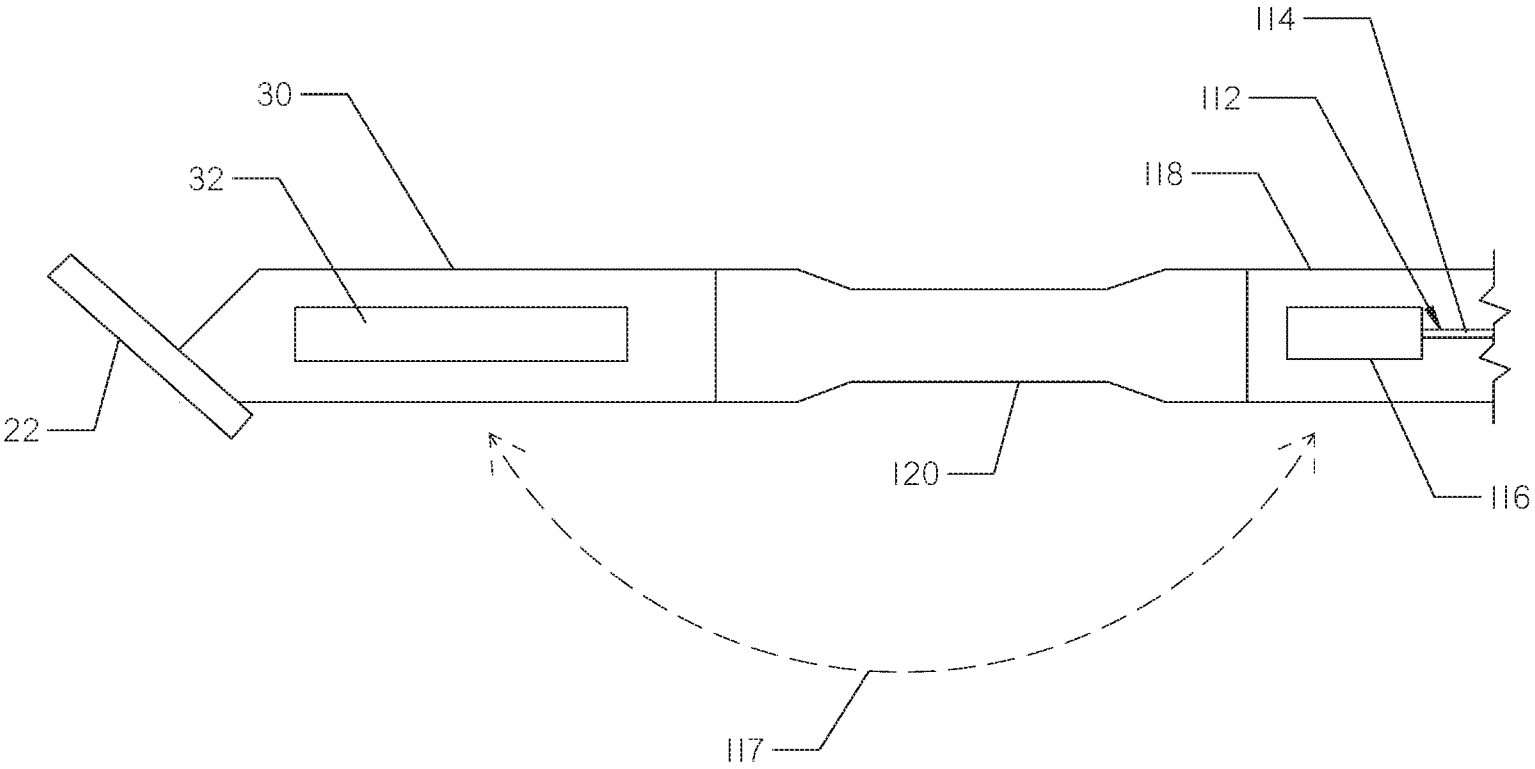
FIG. 10 is a cross-sectional view of a downhole tool attached to a transition sub and a transceiver sub. Another embodiment of a connector is directly attached to a transceiver positioned within the transceiver sub.

Turning to FIG. 10, in another embodiment, the beacon signal 34 is introduced into the conductive path through a connector 112. The connector 112 is identical to the connector 102, but a spine 114 of the connector 112 is connected directly to a transceiver 116 rather than directly to the beacon 32. The transceiver 116 wirelessly communicates with the beacon 32, as shown by the dotted line 117. The beacon 32 transmits the beacon signal 34 to the transceiver 116 and the transceiver 116 transmits the beacon signal 34 to the spine 114 of the connector 112, introducing the beacon signal 34 into the conductive path formed in the drill string 14.

Continuing with FIG. 10, the beacon 32 may be housed in the downhole tool 30 and the connector 112 may be positioned within a transceiver sub 118. The transceiver sub 118 may be attached to one of the pipe sections 42. A bristle assembly supported on the end of the spine 114 may extend into the inner tube 52 of the attached pipe section 42. The transceiver sub 118 may be attached to the downhole tool 30 using a transition sub 120. Alternatively, the transceiver sub 118 may be attached directly to the downhole tool 30.

Figure 11:
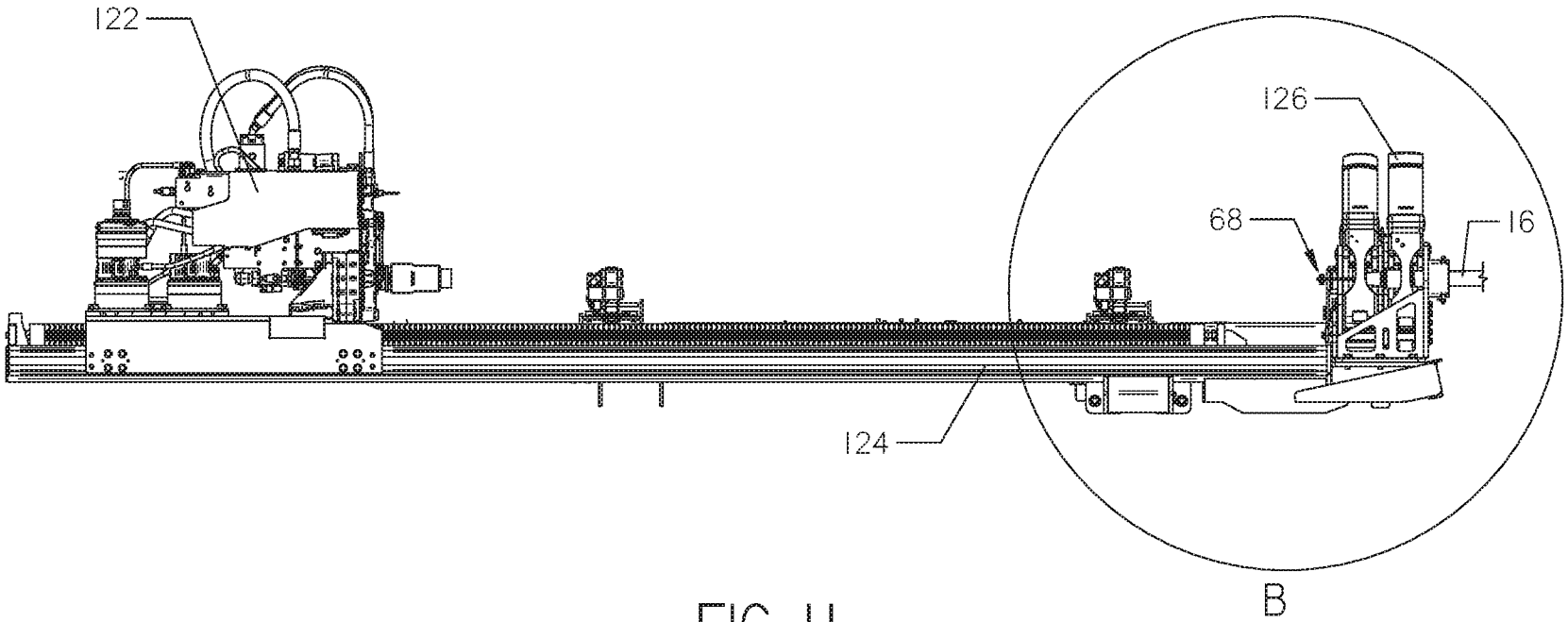
FIG. 11 is a side elevational view of the drill frame supported on the horizontal directional drilling rig shown in FIG. 1. A first end of the drill string is shown gripped by wrenches supported on the drill frame. The connector shown in FIG. 4 is installed within the first end of the drill string.
Figure 12:
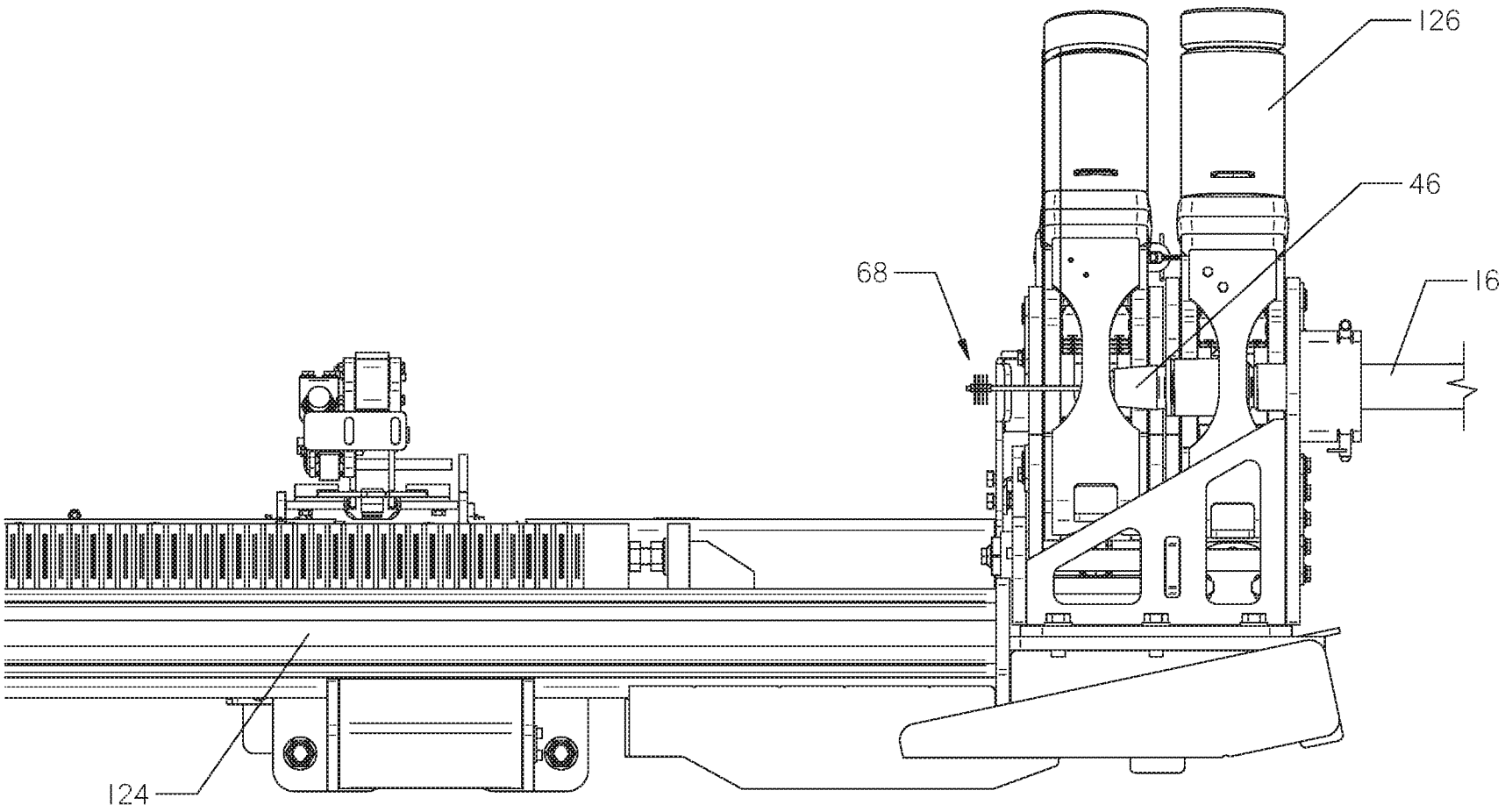
FIG. 12 is an enlarged view of area B shown FIG. 11.

With reference to FIGS. 1, 11 and 12, a connector 68 is installed within each pipe section 42 at the ground surface 26 as the drill string 14 is made-up. During drilling operations, a carriage 122 moves back and forth along a drill frame 124 attaching pipe sections 42 to the drill string 14. The first end 16 of the drill string 14 is held by wrenches 126 supported on the end of the drill frame 124. Prior to attaching a new pipe section 42 to the first end 16 of the drill string 14, an operator inserts a connector 68 into the first end 16 of the drill string 14, as shown in FIGS. 11 and 12. The connector 68 is inserted into the pin end 46 of the pipe section 42 until the stop element 86 engages the internal shoulder 66, as shown in FIGS. 6-8. The insertion of the connector 68 may be done either manually by the operator, or it may be accomplished by a mechanical insertion device (not shown). The mechanical insertion device may operate upon command from the operator, or automatically once the pipe section is clear of obstruction and free to receive a connector 68.

The pipe sections 42 shown in FIGS. 11 and 12 are being attached with the pin end 46 facing upstream or "pin-up". In alternative embodiments, the pipe sections 42 may be attached with the pin end 46 facing downstream or "pin-down". In such embodiment, the connector 68 would be inserted into the pin end 46 of the pipe section 42 held by the carriage 122, prior to attaching such pipe section 42 to the first end 16 of the drill string 14.

Figure 13:
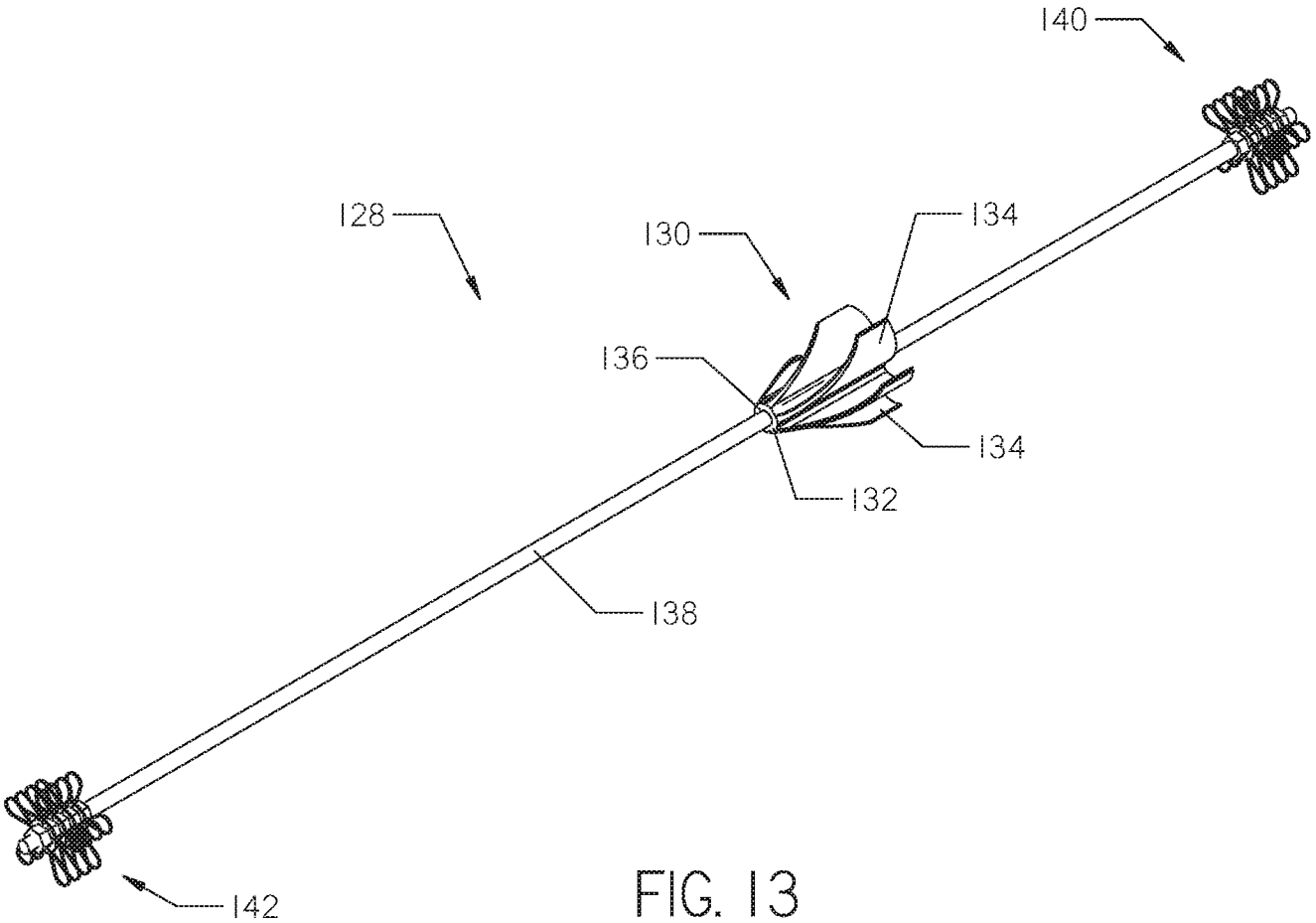
FIG. 13 is a perspective view of another embodiment of a connector.

Turning to FIG. 13, another embodiment of a connector 128 is shown. The connector 128 is identical to the connector 68, but comprises another embodiment of a rigid stop element 130. The stop element 130 comprises a central body 132 having a plurality of radially extending blades 134, The blades 134 are arranged about the periphery of the central body 132 and are each curved towards an adjacent blade 134 such that each blade has a convex outer surface and a concave inner surface. The stop element 130 is made of a nonconductive material, such as plastic.

A central passage 136 extends through the central body 132 for receiving a spine 138. The stop element 130 may reside within a notch formed in the spine 138. Alternatively, the stop element 130 may be molded onto the spine 138 or affixed to the spine 138 using apoxy or other adhesive such that the stop element 130 is not free to move relative to the spine 138. Like the connector 68, a first and second bristle assembly 140 and 142 are supported on opposite ends of the spine 138. The bristle assemblies 140 and 142 shown in FIG. 13 are identical to the bristle assemblies 76 and 78. However, the bristle assemblies 140 and 142 may have different shapes and sizes, as desired.

Figure 14:
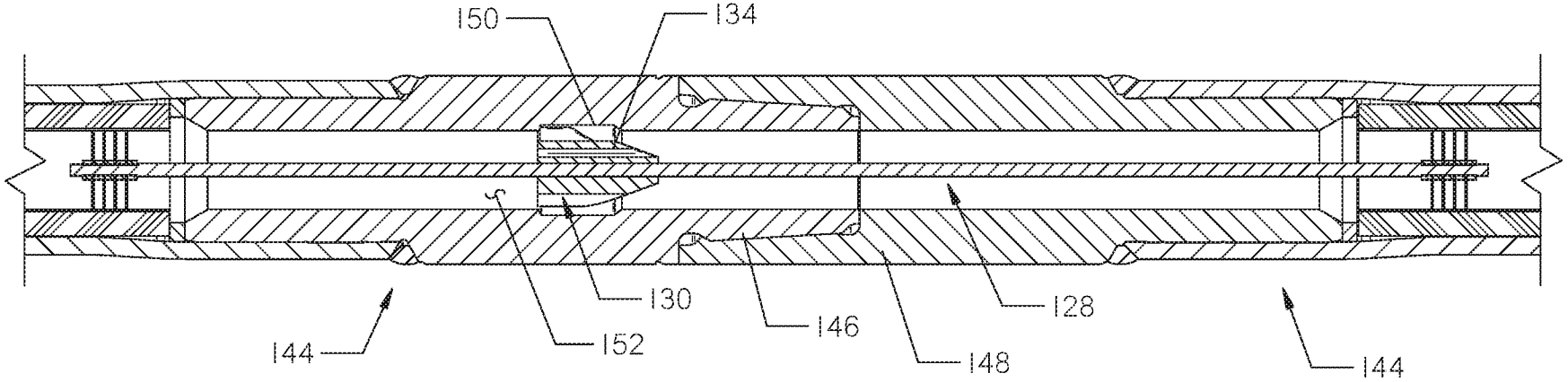
FIG. 14 is a cross-sectional view of a pipe joint made of another embodiment of a pipe section with the connector shown in FIG. 13 disposed within the joint.

Turning to FIG. 14, another embodiment of a pipe section 144 is shown. The pipe section 144 is configured to receive the connector 128. The pipe section 144 is identical to the pipe section 42, with the exception of its pin and box ends 146 and 148. Instead of trapping a stop element between internal shoulders, as shown in FIG. 7, a groove 150 is formed in the walls surrounding an internal bore 152 within the pin end 146. The groove 150 is configured to receive the stop element 130. As the connector 128 is inserted into the pin end 146, the blades 134 compress. Once the stop element 130 reaches the groove 150, the blades 134 expand and engage the walls of the groove 150, preventing further axial movement of the stop element 130 and the connector 128. During operation, fluid flows between the blades 134.

Figure 15:
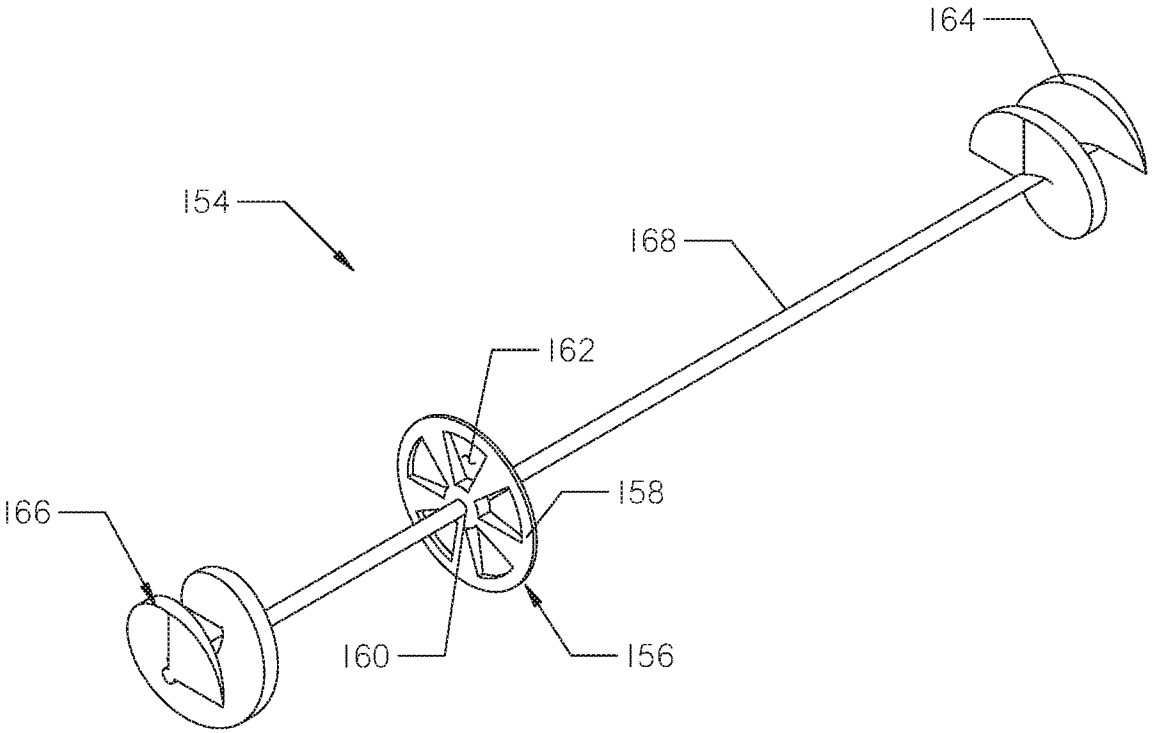

Turning to FIG. 15, another embodiment of a connector 154 is shown. The connector 154 is identical to the connectors 68 and 128, but includes another embodiment of a stop element 156. The stop element 156 comprises a flat, circular body 158 having a central passage 160. The body 158 is perforated by a plurality of openings 162. The stop element 156 is made of a nonconductive material, such as plastic.

A first and second bristle assembly 164 and 166 are supported on a spine 168 of the connector 154. The stop element 156 may reside within a notch formed in the spine 168. Alternatively, the stop element 156 may be molded onto the spine 168 or affixed to the spine 168 using apoxy or other adhesive such that the stop element 156 is not free to move relative to the spine 138. The bristle assemblies 164 and 166 are shown as generic assemblies in FIG. 15. However, each bristle assembly 164 and 166 may be identical to the bristle assemblies 76 and 78 shown in FIG. 4. Alternatively, the bristle assemblies 164 and 166 may have various shapes and sizes as long as the assemblies 164 and 166 are each configured to conductively engage with an inner conductive path formed within the drill string 14. For example, the bristle assemblies 164 and 166 may be comprised of individual wire elements affixed to the spine 168.

Figure 16:
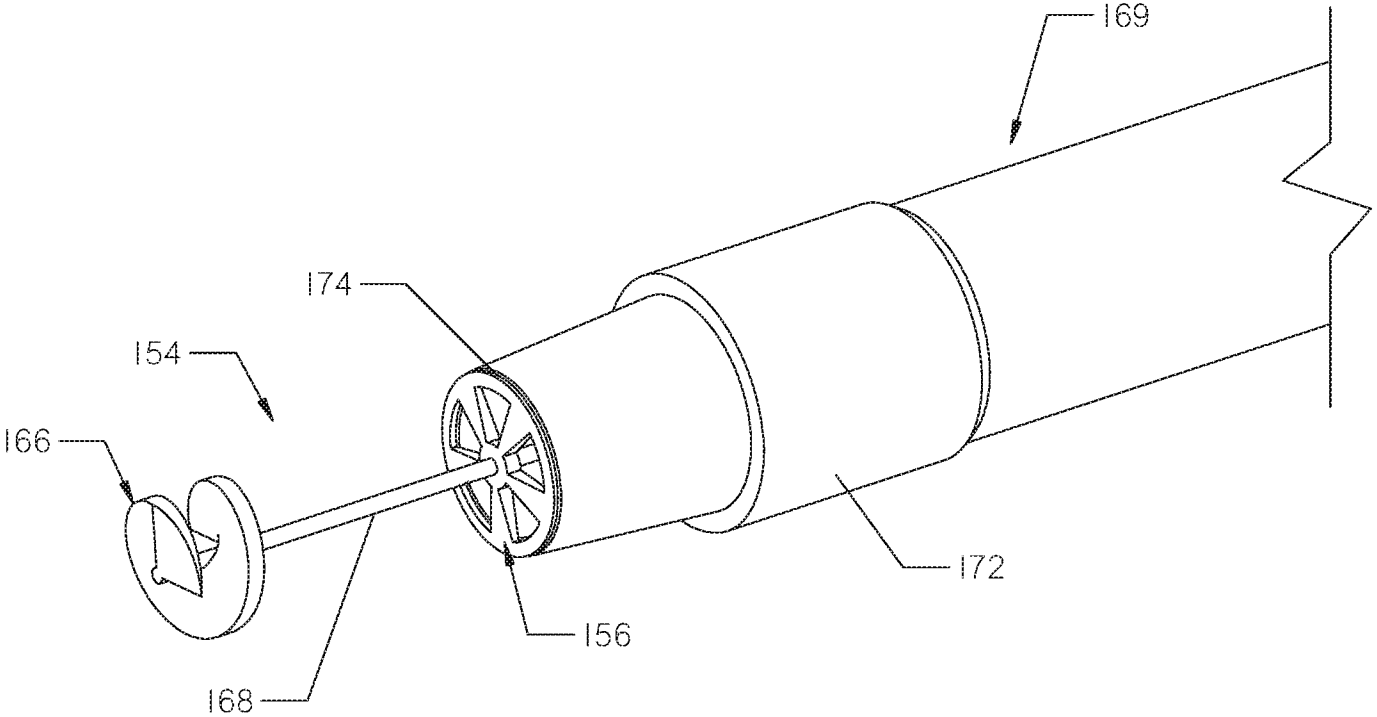
FIG. 16 is a perspective view of another embodiment of a connector.
Figure 17:
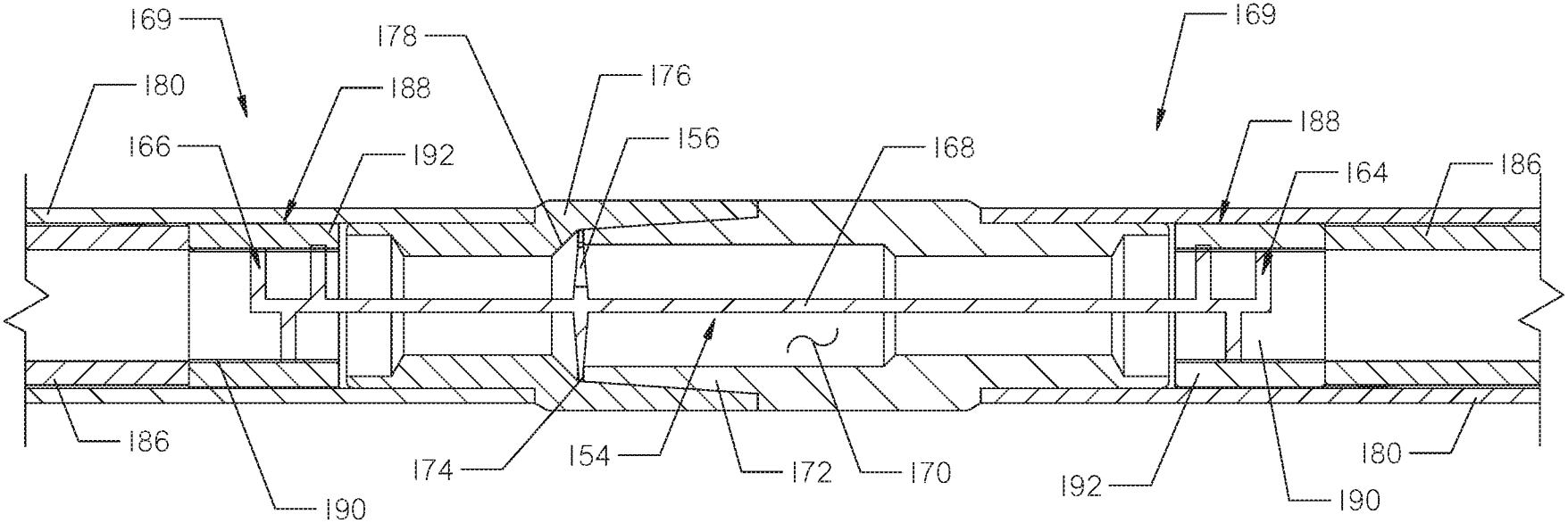
FIG. 17 is a cross-sectional view of a pipe joint made of the pipe section shown in FIG. 16 with the connector shown in FIG. 15 disposed within the joint.

Turning to FIGS. 16 and 17, the connector 154 is shown installed within another embodiment of a pipe section 169. The stop element 156 of the connector 154 is sized so as to not pass into an internal bore 170 formed within a pin end 172 of the pipe section 169. Rather, the stop element 156 engages a front face 174 of the pin end 172. When a box end 176 of an adjacent pipe section 169 is joined to the pin end 172, the stop element 156 is trapped between the front face 174 of the pin end 176 and an internal face 178 formed in the box end 176, as shown in FIG. 17.

Continuing with FIG. 17, the pipe section 169 comprises an outer tube 180 attached to or integrally formed with the pipe section's pin and box ends 172 and 176. The outer tube 180 and the pin and box ends 172 and 176 are made of a wear-resistant metal, such as steel. Because steel is conductive, the outer tube 180 and pin and box ends 172 and 176 may be considered the outer conductive path of the pipe section 169.

Figure 18:
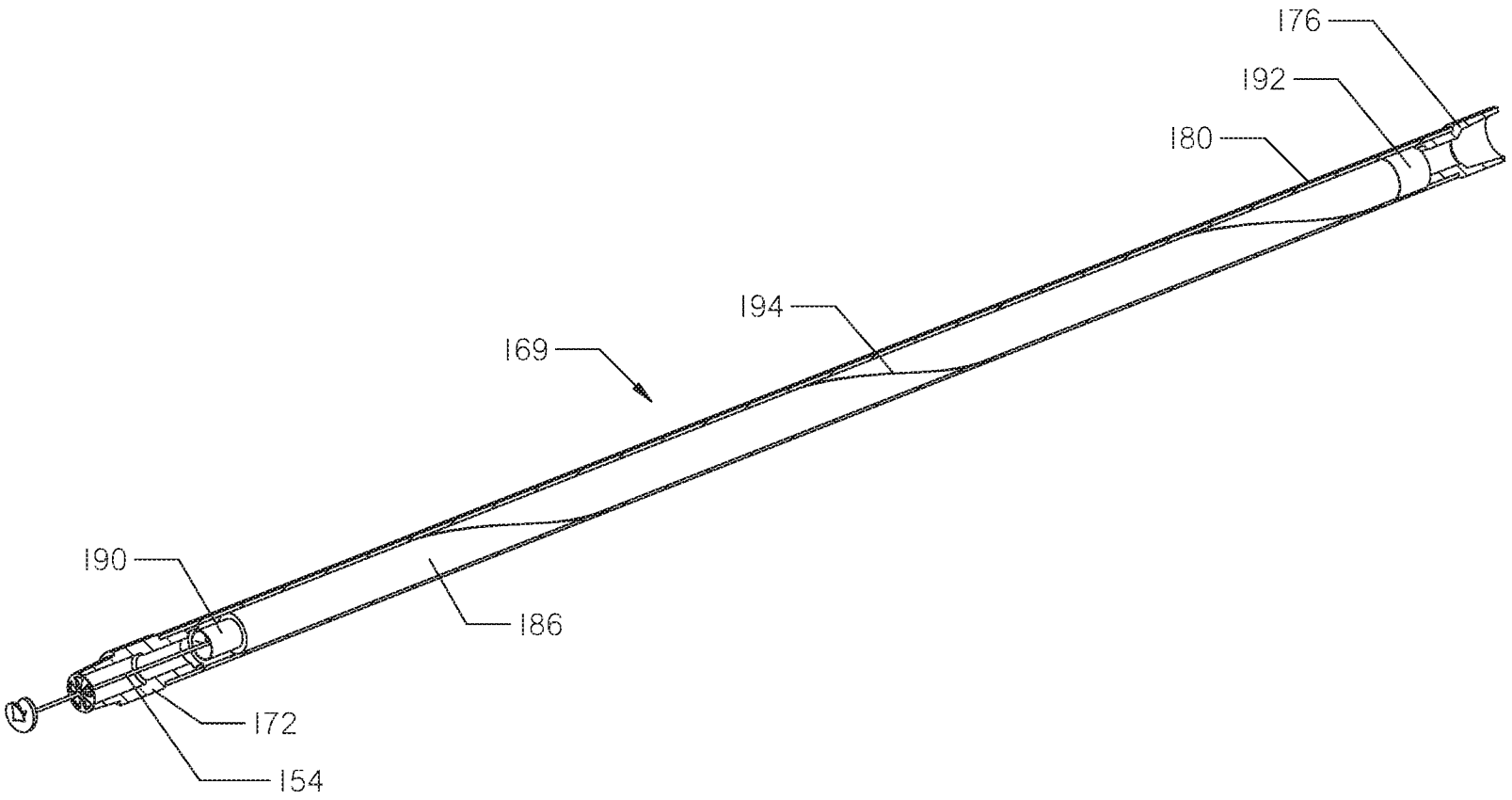
FIG. 18 is a perspective view of the downstream pipe section shown in FIG. 17. A portion of the pipe section has been cut away to expose the inner tube. The connector shown in FIG. 15 is partially disposed within the pin end of the pipe section.

An inner tube 186 is disposed within the outer tube 180 and a bushing assembly 188 is positioned at each end of the inner tube 186 within the outer tube 180. The bushing assemblies 188 are positioned between the inner tube 186 and the pin and box ends 182 and 184. A spacer (not shown) may be positioned between each bushing assembly 188 and the pin and box ends 172 and 176. Each of the bushing assemblies 188 comprises an inner bushing 190 and an outer bushing 192. The inner bushings 190 are connected by a wire 194 that extends the length of the inner tube 186, as shown in FIG. 18. The wire 194 may wrap around or be installed within the outer surface of the inner tube 186, as shown in FIG. 18. Alternatively, the wire 194 may be positioned within the internal bore 170 that extends through the inner tube 186.

The inner bushings 190 and the wire 194 are made of a more conductive metal than the outer tube 180, such as brass, copper or aluminum. The beacon signal 34 is transmitted through the inner bushings 190 and the wire 194. Thus, the inner bushings 190 and the wire 194 may be considered the inner conductive path of the pipe section 169. Preferably, the wire 194 will comprise a durable, nonconductive coating along its length to prevent electrical contact between the wire 194 and the outer tube 180.

The inner tube 186 and outer bushings 192 are made of a nonconductive material, such as PVC or other plastic. The inner tube 186 and outer bushings 192 insulate the inner bushings 190 and the wire 194 from the outer tube 180 in order to prevent the metal outer tube 180 from interfering with the beacon signal 34.

Continuing with FIG. 17, the connector 154 is installed within adjoined pipe sections 169 such that each bristle assembly 164 and 166 engages an inner bushing 190. The beacon signal 34 travels from the downstream inner bushing 190 to the upstream inner bushing 190 through the wire 194. Once in the upstream inner bushing 190, the beacon signal 34 passes into the first bristle assembly 164. The beacon signal 34 passes from the first bristle assembly 164 to the spine 168, into the second bristle assembly 166, and into the corresponding inner bushing 190.

During operation, the beacon 32, when awake, may continually transmit the beacon signal 34 through the drill string 14 to drill rig 22. An above-ground tracker 38 may be used in addition to the telemetry pipe systems described herein.

One or more kits may be useful in assembling the drill string 14. A kit may comprise a plurality of the connectors 68, 128, or 154, and a plurality of the pipe sections 42, 144 or 169. The kit may also comprise one of the connectors 102 or 112.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

The invention claimed is:

1. A connector, comprising:

an elongate and conductive spine having opposed first and second ends;

a first bristle assembly formed from a plurality of conductive bristles that conductively engage the spine adjacent its first end, extend radially therefrom and are arranged peripherally thereabout;

a second bristle assembly formed from a plurality of conductive bristles that conductively engage the spine adjacent its second end, extend radially therefrom and are arranged peripherally thereabout; and a rigid nonconductive stop element supported by the spine intermediate its first and second ends.

2. The connector of claim 1, in which the stop element is perforated by a plurality of openings.

3. The connector of claim 1, in which the stop element comprises a plurality of radially-extending blades.

4. The connector of claim 1, in which the conductive bristles each have a looped shape.

5. The connector of claim 1, in which the spine and the conductive bristles are made of a metal selected from the group consisting of brass, bronze, copper, aluminum, and silver.

6. A kit, comprising:

the connector of claim 1; and a hollow pipe section having an inner bore extending therethrough, the pipe section having an outer conductive path and an inner conductive path, the inner conductive path insulated from the outer conductive path and exposed to at least a portion of the inner bore;

in which each bristle of the bristle assembly has a free end and is sized to engage the inner conductive path at that free end.

7. The kit of claim 6, in which the outer and inner conductive paths each comprise a metal tube, and in which the inner conductive path is insulated from the outer conductive path by an insulated layer, the insulated layer comprising a nonconductive tube.

8. The kit of claim 6 in which the pipe section has opposed ends and in which the outer conductive path extends end-to-end and the inner conductive path terminates short of each end.

9. The kit of claim 6, in which the inner conductive path is made of brass.

10. A system, comprising:

the kit of claim 6, in which the connector is at least partially received within the pipe section.

11. The kit of claim 6, in which the pipe section further comprises:

an annular shoulder formed in a wall or walls defining the inner bore.

12. A system comprising:

the kit of claim 11, in which the connector is installed within the pipe section such that the first bristle assembly engages the inner conductive path and the stop element engages the annular shoulder.

13. The kit of claim 6, in which the inner conductive path comprises a pair of conductive bushings joined by a conductive wire.

14. The kit of claim 13, in which each of the conductive bushings is insulated from the conductive outer path by a nonconductive bushing.

15. The kit of claim 6, in which the connector is one of a plurality of identical connectors, and in which the pipe section is one of a plurality of identical pipe sections.

16. A system comprising:

the kit of claim 15, in which the plurality of pipe sections are disposed in end-to-end engagement and form a drill string; and in which the plurality of connectors are installed within the drill string such that a single connector extends between adjacent pipe sections and interconnects adjacent inner conductive paths.

17. The system of claim 16, in which the drill string has opposed first and second ends, the system further comprising:

a horizontal boring machine supported on a ground surface and operatively engaging the first end of the drill string; and a boring tool operatively engaging the second end of the drill string.

18. The system of claim 17, further comprising:

a beacon incorporated into the drill string and configured to communicate with an adjacent connector.

19. The system of claim 17, in which the connectors are configured to transmit a beacon signal from adjacent the second end of the drill string to adjacent the first end of the drill string.

20. The kit of claim 6, in which the inner bore defines a fluid path; in which the stop element is perforated by a plurality of openings; and in which the plurality of openings define a portion of the fluid path.

21. The connector of claim 1, in which the connector is configured to be installed within a hollow pipe section having an inner bore extending therethrough, in which the connector is configured to be installed within the pipe section such that the spine is centrally disposed within the inner bore.

22. The connector of claim 1, in which a length of the spine is greater than a length of the stop element.

23. A connector, comprising:

an elongate and conductive spine having opposed first and second ends; in which the spine comprises a plurality of twisted metal wires;

a first bristle assembly formed from a plurality of conductive bristles that conductively engage the spine adjacent its first end, extend radially therefrom and are arranged peripherally thereabout;

a second bristle assembly formed from a plurality of conductive bristles that conductively engage the spine adjacent its second end, extend radially therefrom and are arranged peripherally thereabout; and a rigid nonconductive stop element supported by the spine intermediate its first and second ends.

24. A connector, comprising:

an elongate and conductive spine having opposed first and second ends;

a first bristle assembly formed from a plurality of conductive bristles that conductively engage the spine adjacent its first end, extend radially therefrom and are arranged peripherally thereabout;

a second bristle assembly formed from a plurality of conductive bristles that conductively engage the spine adjacent its second end, extend radially therefrom and are arranged peripherally thereabout; and a rigid nonconductive stop element supported by the spine intermediate its first and second ends; in which a portion of the stop element resides within a notch formed in the spine.

* * * * *